US008714138B2

(12) United States Patent
Uchiyama et al.

(10) Patent No.: US 8,714,138 B2
(45) Date of Patent: May 6, 2014

(54) INTAKE STRUCTURE OF MOTORCYCLE

(75) Inventors: Tatsushi Uchiyama, Shizuoka-Ken (JP); Ikuo Yamada, Shizuoka-Ken (JP)

(73) Assignee: Suzuki Motor Corporation, Hamamatsu-Shi, Shizuoka-Ken (JP)

( * ) Notice: Subject to any disclaimer, the term of this patent is extended or adjusted under 35 U.S.C. 154(b) by 89 days.

(21) Appl. No.: 13/482,764

(22) Filed: May 29, 2012

(65) Prior Publication Data

US 2012/0304965 A1 Dec. 6, 2012

(30) Foreign Application Priority Data

May 30, 2011 (JP) ..... 2011-120690
May 30, 2011 (JP) ..... 2011-120691

(51) Int. Cl.
*B62D 61/02* (2006.01)
*F02M 55/00* (2006.01)

(52) U.S. Cl.
USPC ..... 123/399; 123/468; 180/219; 180/231

(58) Field of Classification Search
USPC ..... 123/399, 468; 180/219, 231
See application file for complete search history.

(56) References Cited

U.S. PATENT DOCUMENTS 5,577,570 A * 11/1996 Shiohara et al. ..... 180/219
6,202,626 B1 3/2001 Ito et al.
7,779,950 B2 * 8/2010 Hoeve et al. ..... 180/219
8,439,015 B2 * 5/2013 Kimura et al. ..... 123/456
2002/0050268 A1 5/2002 Deguchi
2006/0042601 A1 * 3/2006 Hotta et al. ..... 123/468
2006/0225708 A1 * 10/2006 Taguchi et al. ..... 123/468
2008/0230037 A1 * 9/2008 Fujita ..... 123/509
2009/0095252 A1 * 4/2009 Yamada ..... 123/336
2010/0294581 A1 * 11/2010 Niijima et al. ..... 180/219

FOREIGN PATENT DOCUMENTS

DE 102008063210 A1 1/2009
EP 0867608 A2 9/1998
JP 2002129987 5/2002
JP 2008274925 11/2008
JP 2010223004 10/2010

OTHER PUBLICATIONS

Extended European Search Report for European Application No. 12170056.1 dated Sep. 20, 2012.

* cited by examiner

*Primary Examiner* — Erick Solis
(74) *Attorney, Agent, or Firm* — Barnes & Thornburg LLP

(57) ABSTRACT

A motorcycle having a head pipe, a vehicle body frame including a pair of left and right main flames extending rearward from the head pipe, and an engine below the vehicle body frame and including a cylinder having an inclined cylinder axis, and an intake device. The intake device has an air cleaner box above the engine and the main frames; a throttle body provided with throttle bores and a valve shaft penetrating the throttle bores, the throttle body is located on a rear side of the engine between the pair of left and right main frames and guides intake air from the air cleaner box to the engine; and a measuring device located on a rear side of the throttle body which rotates about a rotational shaft parallel to the valve shaft to measure a throttle operation amount.

9 Claims, 11 Drawing Sheets

INTAKE STRUCTURE OF MOTORCYCLE

PRIORITY CLAIM

This patent application claims priority to Japanese Patent Application No. 2011-120690, filed 30 May 2011, and Japanese Patent Application No. 2011-120691, filed 30 May 2011, the disclosures of which are incorporated herein by reference in their entirety.

BACKGROUND OF THE INVENTION

1. Field of the Invention

The present invention relates to an intake structure of a motorcycle, which may be referred to as a layout of an intake device or merely an intake device.

2. Description of the Related Art

A conventional intake structure or device of a motorcycle includes an electronically controlled throttle that drives a throttle valve by means of an electric motor to thereby adjust a flow rate of intake air.

A throttle body of such electronically controlled throttle partitions a throttle bore as a flow path that guides intake air from an air cleaner box to an engine. The throttle valve is a valve acting to open and close the throttle bore.

The electronically controlled throttle measures an operation amount of a throttle grip by an accelerator position sensor and determines a control amount of the electric motor, i.e., an opening degree of the throttle valve.

Such an intake structure of a motorcycle in which the accelerator position sensor is arranged outside a main frame is known (for example, refer to Patent Document 1 (Japanese Patent Laid-Open Publication No. 2008-274925)).

The accelerator position sensor measures the operation amount of the throttle grip by measuring a rotation angle of a throttle pulley around which a cable extending from the throttle grip is wound.

According to such arrangement, there may case a possibility in which the throttle pulley is vibrated by vibrations generated during the running of the motorcycle or vibrations generated by the engine, leading rotation of the throttle. As a result, the accelerator position sensor may be erroneously operated and incorrectly measure the operation amount of the throttle grip.

On the other hand, in an adoption of a layout or arrangement in which the accelerator position sensor is located outside the main frame, an outer appearance of a motorcycle is not good and may be easily damaged, particularly, in a so-called naked-type motorcycle having a few exterior parts or components, or a so-called sports-type motorcycle having an exposed main frame, thus being inconvenient.

In the meantime, the motorcycle of the conventional type having an intake structure or device such as mentioned above also includes an engine having a forward inclined cylinder axis and an air cleaner box disposed above (or immediately above), and a fuel tank disposed on a rear side of the air cleaner box.

In such arrangement of a conventional motorcycle, a throttle body is generally arranged in a position on a back surface side of the forward inclined engine or a recessed portion of a lower surface of the air cleaner box, and an electric motor is positioned rearward downward apart from the throttle body (for example, refer to Patent Document 2 (Japanese Patent Laid-Open Publication No. 2002-129987)).

There is also known a motorcycle in which an electric motor is arranged in a manner sandwiched between a head cover of an engine and an air cleaner box (for example, refer to Patent Document 3 (Japanese Patent Laid-Open Publication No. 2010-223004).

In such conventional motorcycle, there was adopted an arrangement in which, in order to protect an electric motor of an electrically controlled throttle from heat generated by an engine, and to ensure a volume of a fuel engine, the electric motor is arranged below the throttle body and a throttle valve and the electric motor is connected by means of wire cable. In order to realize such arrangement, it is required for the conventional motorcycle to be provided with considerably large area for disposing the throttle valve and the electric engine. On the other hand, even if such area is minimized, there requires countermeasure against generated heat to the electric motor.

In addition, conventional technology has provided another conventional motorcycle in which an electric motor is arranged in a manner sandwiched between the head cover and the air cleaner box to thereby improve degree of freedom for the layout around the cylinder of the engine. However, in order to ensure an area for arranging the electric motor therebetween, it is required for the air cleaner to have a small-sized structure, leading difficulty for ensuring sufficient area for disposing the air cleaner box.

SUMMARY OF THE INVENTION

The present invention was conceived in consideration of the circumstances encountered in the prior art mentioned above, and an object thereof is to provide an intake structure (device) of a motorcycle capable of measuring an operation amount of a throttle grip with high reliability even in a vibrated environment and providing an good outer appearance or configuration.

Another object of the present invention is to provide an intake structure or device of a motorcycle capable of realizing a layout in which the throttle body and the electric motor are tightly arranged to reduce an area required for such layout or arrangement.

In order to achieve the above objects, the present invention provides, in one aspect, an intake structure of a motorcycle having a head pipe, a vehicle body frame including a pair of left and right main frames extending rearward from the head pipe, and an engine disposed below the vehicle body frame and including a cylinder having an inclined cylinder axis, the intake structure comprising:

an air cleaner box disposed above the engine and the main frames;

a throttle body provided with a plurality of throttle bores formed and arranged in a vehicle width direction of the vehicle body frame and a valve shaft penetrating the throttle bores so as to extend in the vehicle width direction of the vehicle body frame, the throttle body being located on a rear side of the engine and between the pair of left and right main frames and configured to guide intake air from the air cleaner box to the engine; and a measuring device located on a rear side of the throttle body and configured to rotate about a rotational shaft parallel to the valve shaft to thereby measure a throttle operation amount.

According to the above aspect of the present invention, there can be provided an intake structure, which may be called as intake device, of the motorcycle capable of measuring an operation amount of a throttle grip with high reliability even in the location in a vibration environment, and the outer appearance of the motorcycle can be prevented from being spoiled by running wind to the running motorcycle.

In another aspect of the present invention, there is also provided an intake structure of a motorcycle having a head pipe, a vehicle body frame extending rearward from the head pipe, a fuel tank, and an engine disposed below the vehicle body frame and including a cylinder having an inclined cylinder axis and a cylinder head closing a top portion of the cylinder, the intake structure comprising:

an air cleaner box disposed above the engine and the main frames and on a rear side of the fuel tank;

a throttle body including a throttle valve located between the air cleaner box and the cylinder head and configured to adjust a flow rate of an intake air, the throttle body being located below the air cleaner box on a rear side of the cylinder head;

an electric motor located in a projected area on the rear side of the cylinder head and configured to open and close the throttle valve; and a fuel supply pipe disposed between the cylinder and the electric motor and connecting the fuel tank and the cylinder head.

According to the above aspect of the present invention, there is provided an intake structure of a motorcycle in which the throttle body and the electric motor can be closely arranged in a narrow space, thereby providing a compact arrangement of components.

The nature and further characteristic features of the present invention will be made clearer from the following descriptions made with reference to the accompanying drawings.

DESCRIPTION OF THE PREFERRED EMBODIMENT

Figure 1:
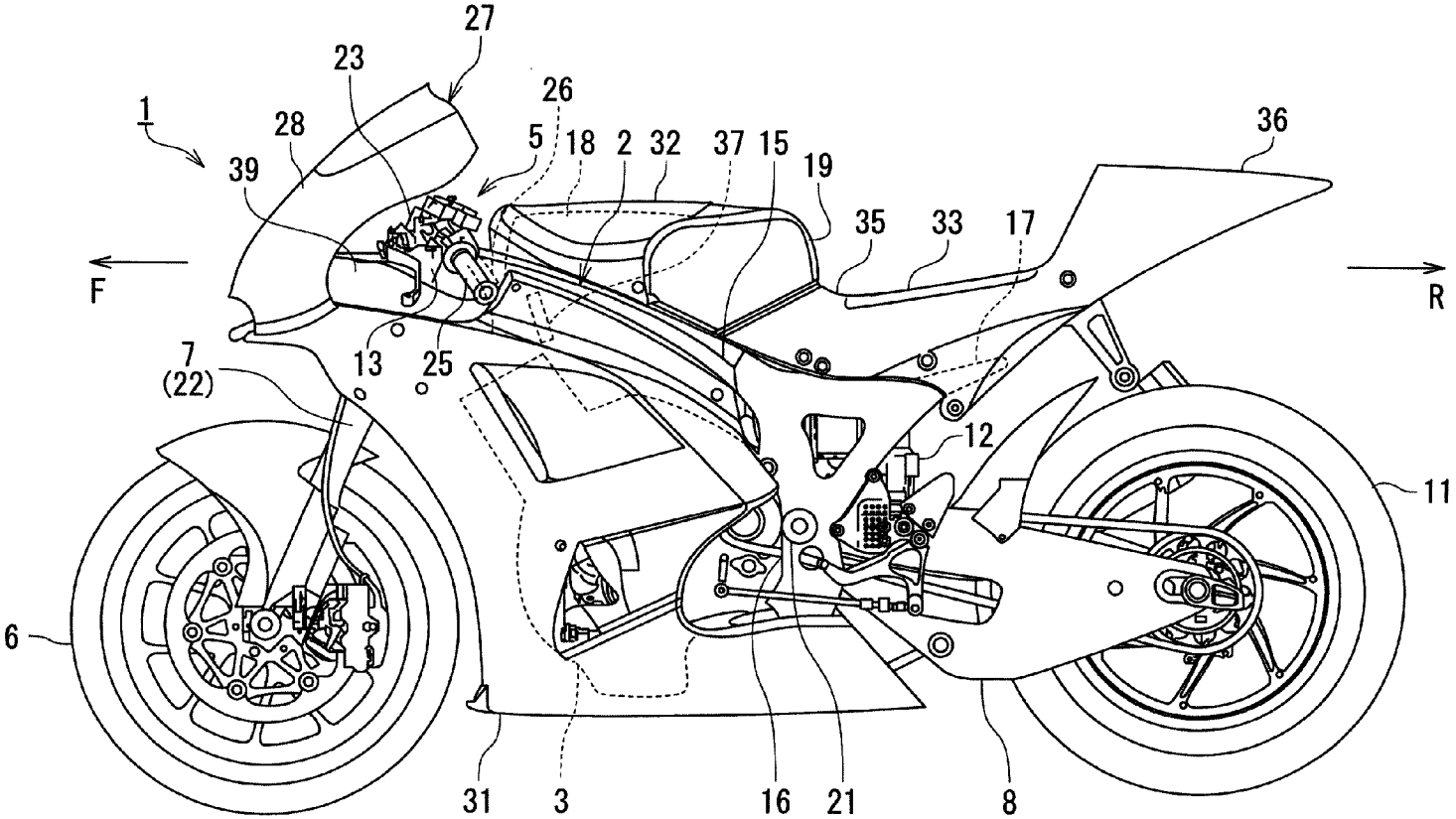
FIG. 1 is a left side view illustrating a motorcycle provided with an intake structure (intake device) according to an embodiment of the present invention.

In the following, an embodiment of an intake structure (or intake device) of a motorcycle according to the present invention will be described by reference to FIGS. 1 to 11. It is further to be noted that terms "upper", "lower", "right", "left" and like terms showing direction are used herein with reference to the accompanying drawings or in a standing state of a motorcycle such as shown in FIG. 1. That is, for the following description of the embodiment of the present invention, a solid arrow F in FIG. 1 is defined as a front (forward) side and a solid arrow R in FIG. 1 is defined as a rear (rearward) side in a longitudinal direction of a motorcycle 1. A left-hand side as viewed from a rider of the motorcycle 1 is defined as a left side of the motorcycle 1, and an opposite side thereof is defined as a right side of the motorcycle 1. A head side of a rider of the motorcycle 1 is defined as an upper side of the motorcycle 1, and an opposite side thereof is defined as a lower side of the motorcycle 1.

As shown in FIG. 1, the motorcycle 1 includes a vehicle body frame 2, an engine 3, a steering mechanism 5, a front wheel 6, a front-wheel suspension device 7, a swing arm 8, a rear wheel 11, and a rear-wheel suspension device 12.

The engine 3 is located below a front half portion of the vehicle body frame 2. The steering mechanism 5 is positioned at a front end portion of the vehicle body frame 2 to be swingable in a right and left direction. The front wheel 6 is disposed at a lower end portion of the steering mechanism 5 and contacts the ground. The front-wheel suspension device 7 is interposed between the vehicle body frame 2 and the front wheel 6. The swing arm 8 is located at a rear portion of the vehicle body frame 2 to be swingable in a vertical direction. The rear wheel 11 is disposed at a rear end portion of the swing arm 8 and contacts the ground. The rear-wheel suspension device 12 is suspended between the vehicle body frame 2 and the swing arm 8.

The vehicle body frame 2 is a twin-tube type frame, for example. The vehicle body frame 2 includes a steering head pipe 13 disposed at the front end portion of the vehicle body frame 2, a right and left pair of main frames 15 branched so as to extend rearward at right and left thereof immediately after the steering pipe 13, a pair of right and left center frames 16 connected to rear end portions of the main frames 15 and extend downward, and a pair of right and left seat rails 17 coupled to the rear end portions of the main frames 15 so as to extend slightly upward in a rearward direction of the vehicle body.

The steering head pipe 13 swingably supports the steering mechanism 5.

The main frames 15 are branched immediately after the steering head pipe 13 so as to slightly descend toward the vehicle rear side with a distance therebetween being gradually widened. The main frames 15 are frames provided with function as a tank rail. The main frames 15 support an air cleaner box 18 located above a front half portion thereof, and a fuel tank 19 located above a rear half portion thereof. The main frames 15 also support the engine 3 disposed below the main frames 15.

The center frames 16 hold a pivot shaft 21 that extends in a vehicle width direction and swingably supports the swing arm 8.

The engine 3 is located posterior to the front wheel 6 and below the main frames 15 so as to occupy a center lower portion of the motorcycle 1.

The steering mechanism 5 includes a steering shaft, not shown, in a manner of penetrating the steering head pipe 13 and act as a swing center of the steering mechanism, a pair of right and left front forks 22 extending in a vertical direction, and a pair of right and left handle bars 23 respectively provided adjacent to upper ends of the front forks 22. Each of the handle bars 23 includes a handle grip 25, in which the handle grip 25 disposed on the right side of the motorcycle 1 is a throttle grip 26.

The motorcycle 1 also includes a cowling 27 having a streamline shape that covers at least one portion of the vehicle, for example, a vehicle body portion from a front portion to the center lower portion. The cowling 27 reduces air resistance generated while the motorcycle 1 is running, and protects a rider from a running wind pressure.

The cowling 27 includes a front cover 28, a pair of right and left side covers 31 covering side portions of the engine 3, an air cleaner cover 32 covering the air cleaner box 18, a seat cover 35 supporting a seat 33, and a rear cover 36 covering the rear side of the vehicle body.

The air cleaner box 18 accommodates an air cleaner 37 acting as an air filter that filters intake air into the engine 3.

The motorcycle 1 further includes a pair of right and left air ducts 39 adapted to guide air to the air cleaner box 18 from a suction port 39 formed at a front end of the front cover 28 and opened to the vehicle front side so as to guide the air to the air cleaner 37.

Figure 2:
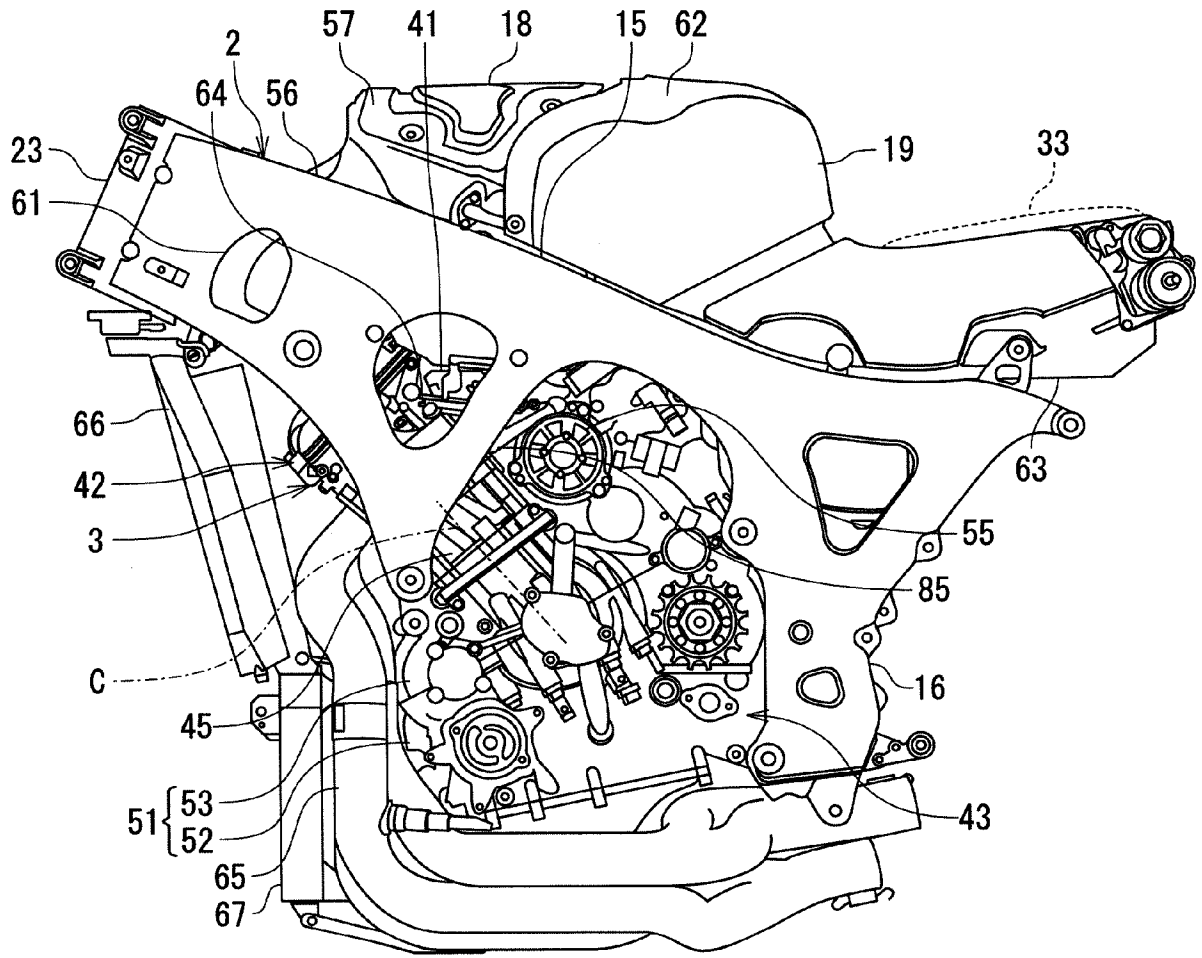
FIG. 2 is a left side view illustrating the intake structure of the motorcycle according to the embodiment of the present invention, from which a cowling is removed.
Figure 3:
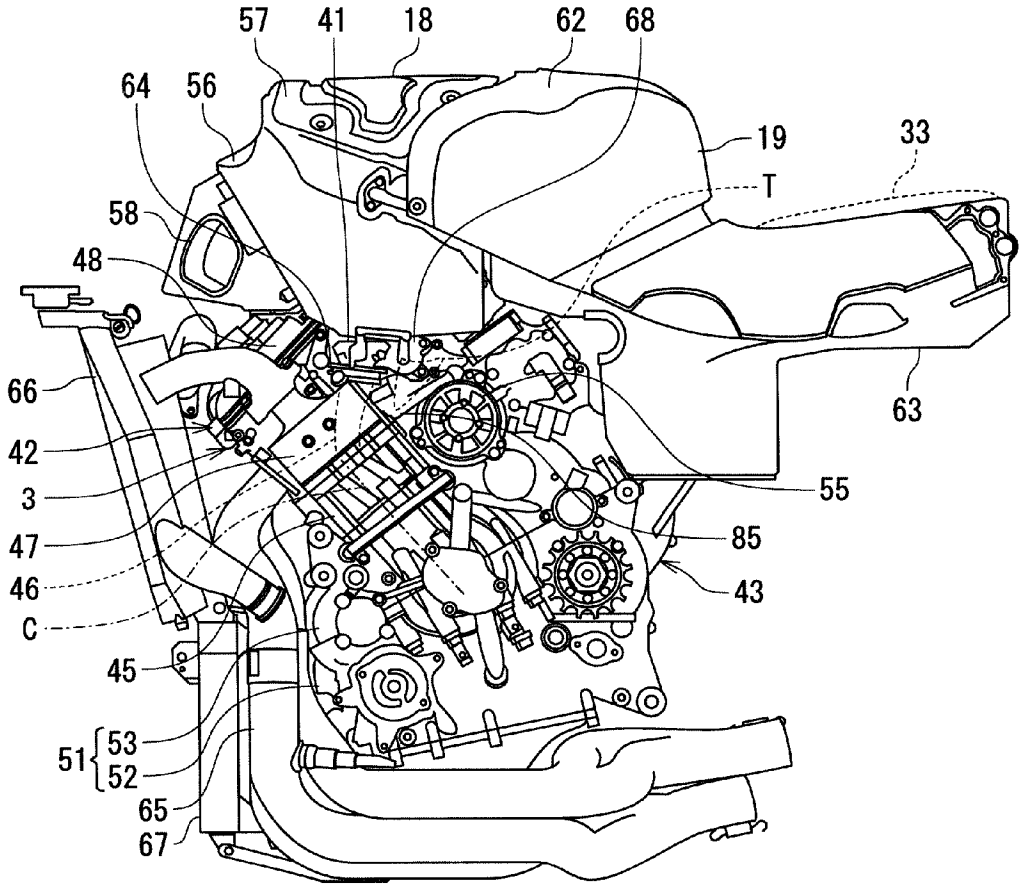
FIG. 3 is a left side view illustrating the intake structure of the motorcycle according to the embodiment of the present invention, from which a vehicle frame is further removed.

FIGS. 2 and 3 are left side views illustrating an intake structure (device or mechanism) of the motorcycle according to the embodiment of the present invention.

FIG. 2 is a view illustrating a region around the engine 3 from which the cowling 27 is removed, and FIG. 3 is a view illustrating the region in FIG. 2 from which the vehicle body frame 2 is further removed.

As shown in FIGS. 2 and 3, the motorcycle 1 includes the vehicle body frame 2, the engine 3 located below the vehicle body frame 2 in which a cylinder axis C is inclined forward, the air cleaner box 18 located above the engine 3 and the main frames 15, the fuel tank 19 disposed on a rear side of the air cleaner box 18 and a throttle body 41 adapted to guide intake air from the air cleaner box 18 to the engine 3.

The engine 3 includes a cylinder assembly 42 disposed immediately below the air cleaner box 18 and between the main frames 15, and a crank assembly 43 connected to a lower end of the cylinder assembly 42 and expands in a longitudinal direction of the vehicle body.

The cylinder assembly 42 includes a cylinder 45 having the cylinder axis C inclined forward, a cylinder head 47 having an intake port 46 that guides the intake air into the cylinder 45, and a head cover 48.

The cylinder 45 is formed with a cylinder bore, not shown, that extends with the cylinder axis C being the center thereof. The cylinder head 47 is connected to an upper end of the cylinder 45 to thereby close a top portion of the cylinder 45. The cylinder head 47 is provided with an exhaust port, not shown, intake and exhaust valves, not shown, and valve mechanisms, also not shown, in addition to the intake port 46. The intake and exhaust valves and the valve train mechanism respectively open and close the intake port 46 and the exhaust port. The head cover 48 is a lid for the cylinder head 47 to close an upper end thereof.

The crank assembly 43 includes a crank case 51 that accommodates a crank shaft and a transmission, both not shown.

The crank case 51 includes an upper case half 52 and a lower case half 53 capable of vertically dividing the crank case 51. The crank case 51 is connected to the cylinder 45, that is, a lower end of the cylinder assembly 42 and expands in the longitudinal direction in a manner such that crank shaft is accommodated in a front half portion near to the cylinder 45, and the transmission is also accommodated therein on the rear side of the crank shaft.

Furthermore, the engine 3 also includes an electrical component 55 that is located on the rear side of the cylinder 45 and forms a valley-like space together with the cylinder 45. The electrical component 55 may be a power generator, for example. The electrical component 55 may be accommodated in the crank case 51 or located outside the crank case 51.

The air cleaner box 18 includes a lower half portion 56 that covers an upper side of the cylinder assembly 42 and is held between the main frames 15, and an upper half portion 57 that projects above the main frames 15 from the lower half portion 56. The air cleaner box 18 also includes a front wall 59 of the lower half portion 56 in addition to the air cleaner 37. The front wall 59 has a pair of right and left air duct connection ports 58 through which running wind is introduced inside.

Since the air duct connection ports 58 are formed in the front wall 59 of the lower half portion 56, the main frames 15 are provided with a pair of right and left through holes 61 in which the air ducts 39 are arranged.

The fuel tank 19 includes a front half portion 62 connected to a rear portion of the air cleaner box 18, and a rear half portion 63 located under the seat 33. The front half portion 62 of the fuel tank 19 extends upward to a higher position than the rear half portion 63, and the rear half portion 63 extends rearward, so that the fuel tank 19 ensures the maximum capacity. The front half portion 62 covers a rear half portion of the crank case 51.

The throttle body 41 as an intake system of the engine 3 is located below the air cleaner box 18 on the rear side of the engine 3 (more specifically, the cylinder head 47). The throttle body 41 is connected to a rear surface of the cylinder head 47 via an intake pipe 64 and leads to the intake port 46. The throttle body 41 is also held between the right and left main frames 15. The intake pipe 64 is a short pipe made of rubber and flexibly supports the throttle body 41 relative to the engine 3.

An exhaust pipe 65 as an exhaust system of the engine 3 is connected to a front surface of the cylinder head 47, leads to the exhaust port, passes sequentially around a front surface and a bottom surface of the engine 3 and extends toward the vehicle rear side.

A cooling system of the engine 3 includes a radiator 66 and an oil cooler 67. The radiator 66 spreads so as to cover a front side of the cylinder assembly 42. The oil cooler 67 spreads so as to cover a front side of the crank case 51 at a portion below the radiator 66.

Figure 4:
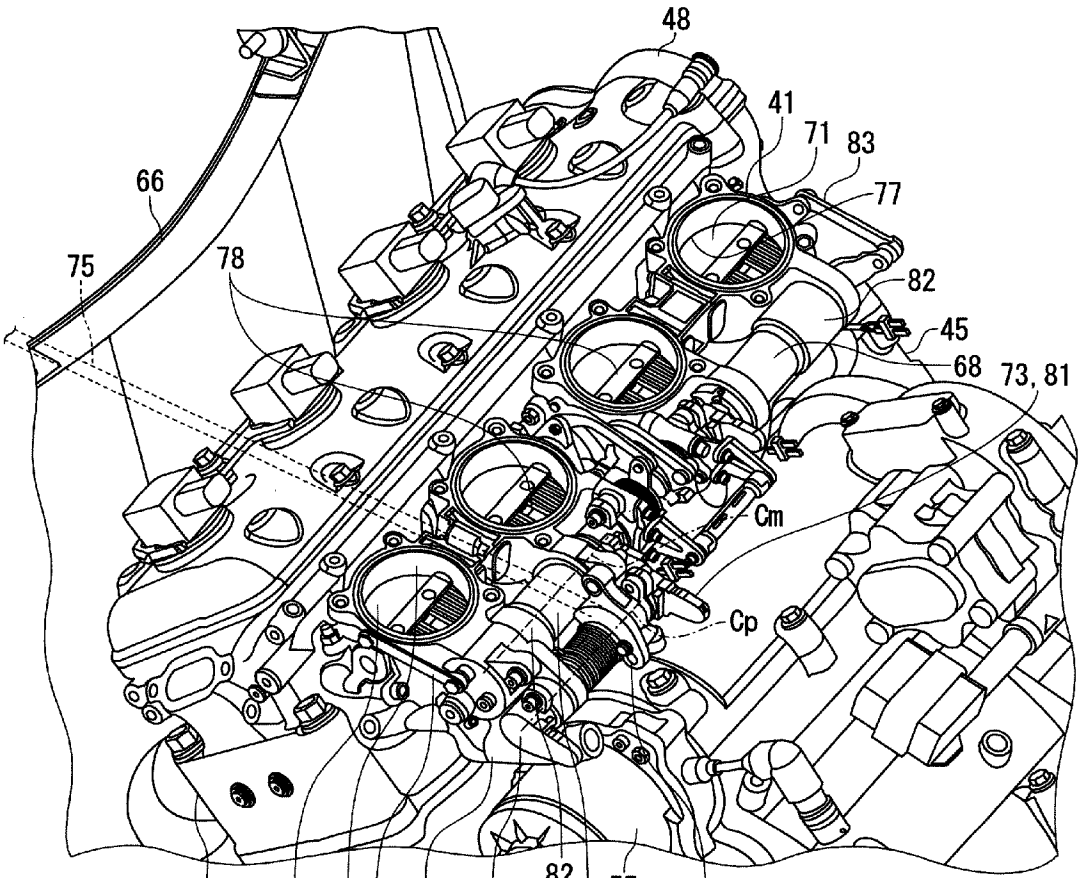
FIG. 4 is a perspective view illustrating the intake structure of the motorcycle according to the embodiment of the present invention.
Figure 5:
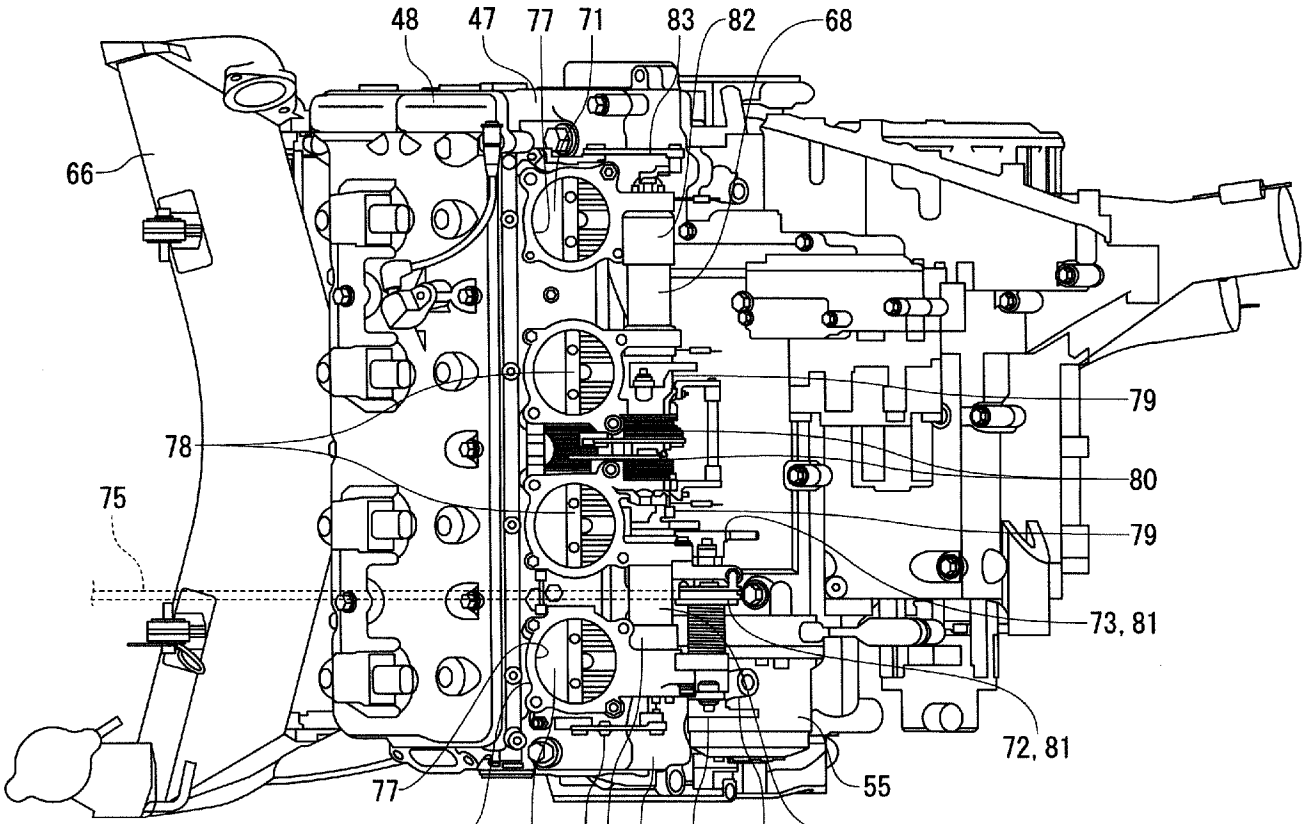
FIG. 5 is a plan view illustrating the intake structure of the motorcycle according to the embodiment of the present invention.

FIG. 4 is a perspective view illustrating the intake structure of the motorcycle according to the embodiment of the present invention, and FIG. 5 is a plan view illustrating the intake structure of the motorcycle.

As shown in FIGS. 4 and 5, the intake structure of the motorcycle 1 includes an electronically controlled throttle that drives opening and closing of a throttle valve 71 by an electric motor 68 to thereby adjust a flow rate of intake air.

The electronically controlled throttle acts to convert an operation amount of the throttle grip 26 into a rotation angle of a throttle pulley 72, which is measured by an accelerator position sensor 73. A duty ratio of the electric motor 68 is controlled according to a measurement amount of the accelerator position sensor 73. The opening and closing of the throttle valve 71 is controlled by driving the electric motor 68. Thus, the electronically controlled throttle controls the driving of the throttle valve 71 in accordance with the operation amount of the throttle grip 26.

The operation amount of the throttle grip 26 corresponds to a twisting angle of the throttle grip 26, and specifically, to a throttle operation amount. A cable 75 extends from a handle 76 to the throttle pulley 72 so as to transmit the operation amount of the throttle grip 26 to the throttle pulley 72.

The throttle body 41 is provided with a plurality of, for example, four throttle bores 77 corresponding to the number of cylinder bores (i.e., the number of cylinders) of the engine 3. The throttle bores 77 are arranged in the width direction of the vehicle (i.e., the vehicle body frame 2), and the throttle bores 77 are communicated respectively with the cylinder bores via the intake ports 46.

The throttle body 41 is also provided with the throttle valve 71 located within each of the throttle bores 77 between the air cleaner box 18 and the cylinder head 47 so as to adjust the flow rate of intake air, and a valve shaft 78 that penetrates the plurality of throttle bores 77 so as to extend in the vehicle width direction of the vehicle body frame 2.

The throttle body 41 further includes a gap between a half body provided with the left-side two throttle bores 77 and another half body provided with the right-side two throttle bores 77.

The valve shaft 78 is a rotation center of a valve body of the throttle valve 71, and two valve shafts 78 are provided. Each of the valve shafts 78 constitutes the rotation center of the valve bodies of the left-side two throttle valves 71 or the right-side two throttle valves 71 with respect to the four throttle bores 77 arranged in the vehicle width direction. The two valve shafts 78 lie on a substantially straight line.

The intake structure of the motorcycle 1 of the present embodiment also includes the electric motor 68, and a measuring device 81. The electric motor 68 is disposed on the rear side of the cylinder head 47 and operates to open and/or close the throttle valves 71. The measuring device 81 is located on the rear side of the throttle body 41 and rotates about a rotational shaft parallel to the valve shaft 78 to thereby measure the throttle operation amount.

The electric motor 68 is more specifically located in a projection area or space on the rear side of the cylinder head 47. That is, the projection area or space means a shadow area when light is applied to the cylinder head and exists the outermost shape of the cylinder head extending in the longitudinal direction thereof. The electric motor 68 is supported at a rear portion of the throttle body 41. Two electric motors 68 are disposed in a manner spaced apart from each other in the vehicle width direction. Each of the electric motors 68 operates to open and/or close the left-side two throttle bores 77 or the right-side two throttle bores 77 with respect to the four throttle bores 77 arranged in the vehicle width direction. Each of the electric motors 68 is located on the rear side of an intermediate position between the two throttle bores 77 to be opened and closed.

The two electric motors 68 include output shafts which lie on a substantially straight line in parallel to the valve shaft 78. The output shafts extend in an external direction of the vehicle.

The electric motors 68 are respectively connected to the valve shafts 78 sequentially through a planetary gear 82 connected to the output shaft of the electric motor 68 and a link mechanism 83 connecting an output shaft of the planetary gear 82 and the valve shaft 78. The planetary gear 82 lies on an output axis of each of the electric motors 68 and is located on the rear side of each of the throttle bores 77 positioned outside of the vehicle in the vehicle width direction.

A pair of link mechanisms 83 is arranged respectively on right and left sides of the throttle body 41. Each of the link mechanisms 83 is suspended between the planetary gear 82 and the valve shaft 78. The electric motors 68 rotationally drive the valve shafts 78 through the planetary gears 82 and the link mechanisms 83, thereby opening and/or closing the throttle valves 71.

The measuring device 81 includes the throttle pulley 72 arranged on the rear side of the electric motor 68 and the accelerator position sensor 73 that measures the rotation angle of the throttle pulley 72. The measuring device 81 is supported by the throttle body 41.

The throttle pulley 72 is located on the rear side of the electric motor 68 that is located further on the rear side of the intermediate position between the left-side two throttle bores 77 and is configured to rotate about the rotational shaft parallel to the valve shaft 78 to thereby measure the throttle operation amount.

The accelerator position sensor 73 includes a pair of accelerator position sensors 73 at both ends of the throttle pulley 72 with the rotational shaft of the throttle pulley 72 being interposed therebetween.

The cable 75 extends through a gap between the throttle bores 77 adjacent to each other in a plan view and transmits an operation of the throttle from the throttle grip 26 to the measuring device 81. More specifically, the cable 75 is connected to the throttle pulley 72 located on the rear side of the intermediate position between the left-side two throttle bores 77 by extending through an upper portion or a lower portion of the gap between the left-side two throttle bores 77. The cable 75 thereby transmits the throttle operation. Thus, the cable 75 does not interfere with the link mechanisms 83 on the right and left sides of the throttle body 41.

The electronically controlled throttle also includes a throttle position sensor 79 that measures an opening degree of the throttle valve 71, and a second link mechanism 80 that transmits an opening degree of the valve shaft 78 to the throttle position sensor 79.

The throttle position sensor 79 includes a right and left pair of throttle position sensors 79. The throttle position sensors 79 are respectively located on the rear side of the two throttle bores 77 on a vehicle center side and on the vehicle center side from the electric motors 68.

The second link mechanism 80 is disposed in the gap between the left-side two throttle bores 77 and the right-side two throttle bores 77 in the half bodies of the throttle body 41. The second link mechanism 80 is suspended between the throttle position sensor 79 and the valve shaft 78.

Figure 6:
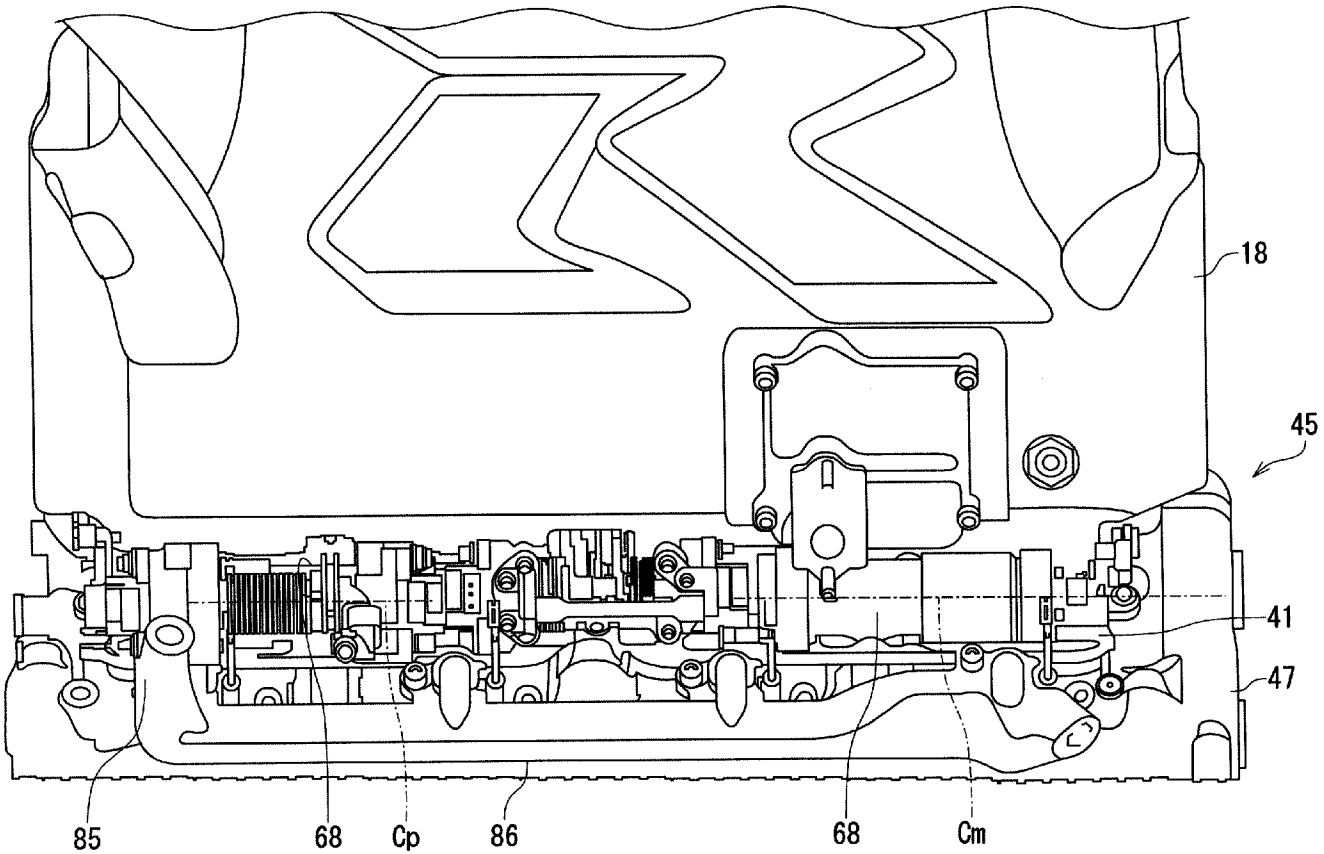
FIG. 6 is a rear view illustrating a structure or layout around a throttle body of the intake structure of the motorcycle according to the embodiment of the present invention.

FIG. 6 is a back side view illustrating a region around the throttle body of the intake structure of the motorcycle according to the embodiment of the present invention.

As shown in FIGS. 3, 4 and 6, the intake structure of the motorcycle 1 according to the present embodiment includes a fuel supply pipe 85 that is arranged between the cylinder 45 and the electric motor 68 and connects the fuel tank 19 and the cylinder head 47.

The fuel supply pipe 85 includes a cylinder head-side connection end 86 located on the rear side of and closest to the cylinder head 47 and below the electric motor 68. The connection end 86 is connected to the cylinder head 47. The cylinder head-side connection end 86 is a branch pipe that extends in the width direction of the cylinder head 47 and branches so as to supply a fuel to the respective cylinders.

The fuel supply pipe 85 is located in the valley-shaped space formed by the cylinder 45 and the electrical component 55.

The electric motor 68 of the electronically controlled throttle is located below the top portion of the throttle body 41.

The fuel supply pipe 85, the electric motor 68 and the throttle pulley 72 of the electronically controlled throttle are disposed in the valley-shaped space formed by the cylinder 45 and the electrical component 55 in a manner such that the cylinder head-side connection end 86 of the fuel supply pipe 85, an output axis Cm of the electric motor 68, and a rotation center line Cp of the throttle pulley 72 are arranged so as to constitute an inverted triangle shape T in the side view of the vehicle. At least one side of the inverted triangle shape is arranged along a wall surface of the engine 3 or a wall surface of the electrical component 55 that defines the valley-shaped space formed by the cylinder 45 and the electrical component 55.

The axis of the valve shaft 78, the output axis Cm of the electric motor 68, and the rotation center line Cp of the throttle pulley 72 lie on a substantially same plane, and are substantially perpendicular to a center line of the throttle bore 77.

The output axis Cm of the electric motor 68 and the extending direction of the cylinder head-side connection end 86 are located within a plane substantially parallel to the center line of the throttle bore 77.

Figure 7:
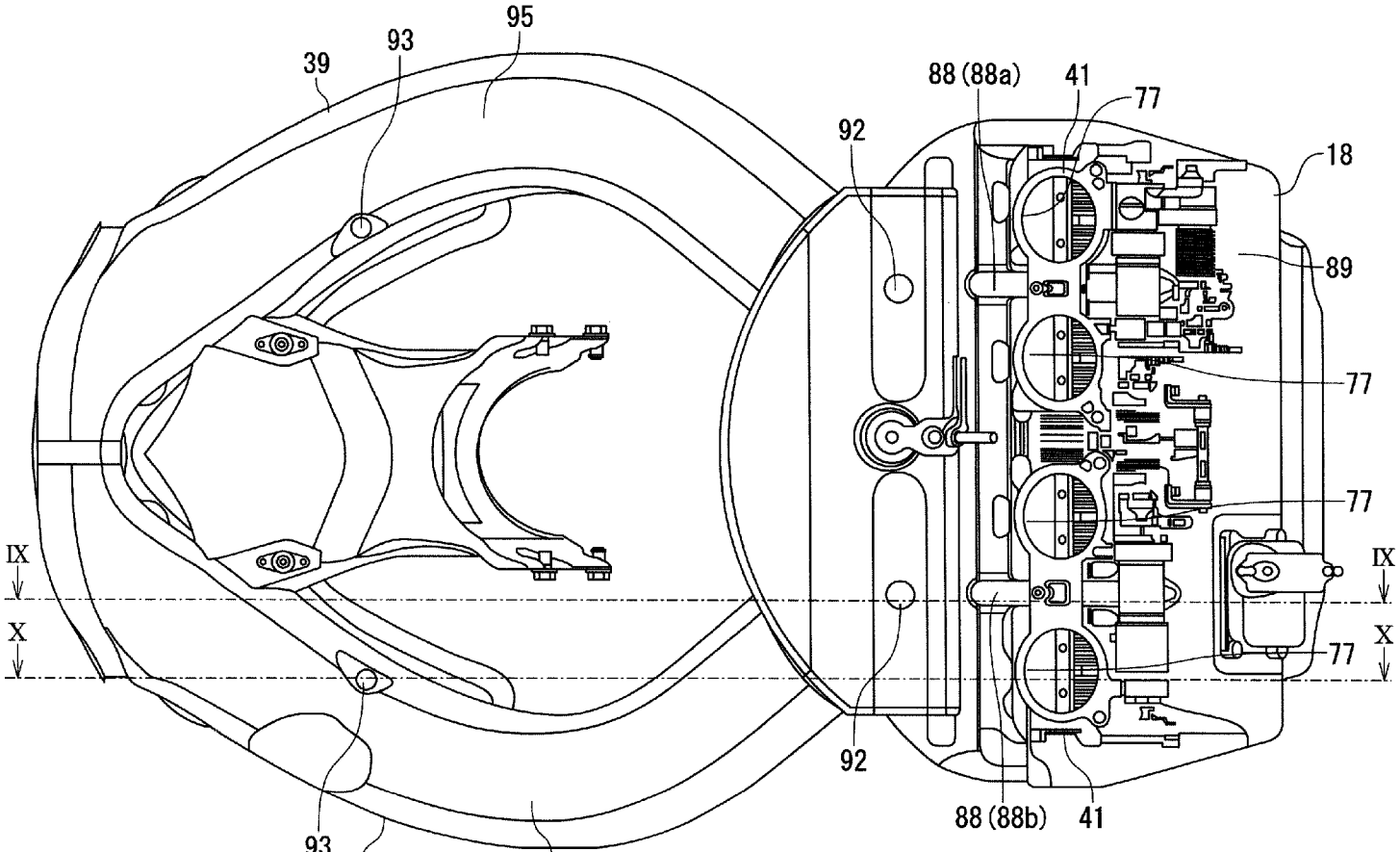
FIG. 7 is a bottom view illustrating the intake structure of the motorcycle according to the embodiment of the present invention.
Figure 8:
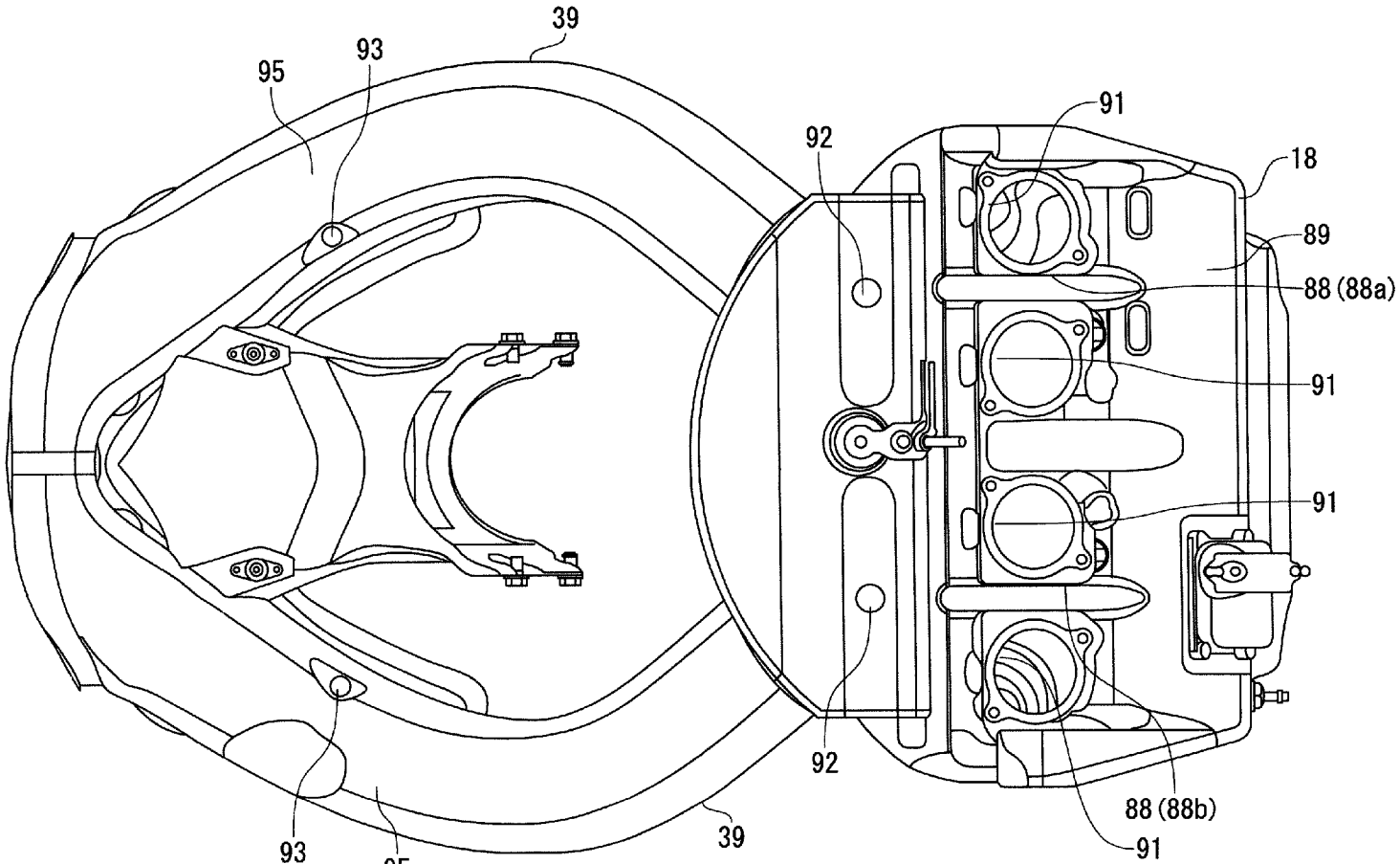
FIG. 8 is a bottom view illustrating air ducts and an air cleaner box of the intake structure of the motorcycle according to the embodiment of the present invention.
Figure 9:
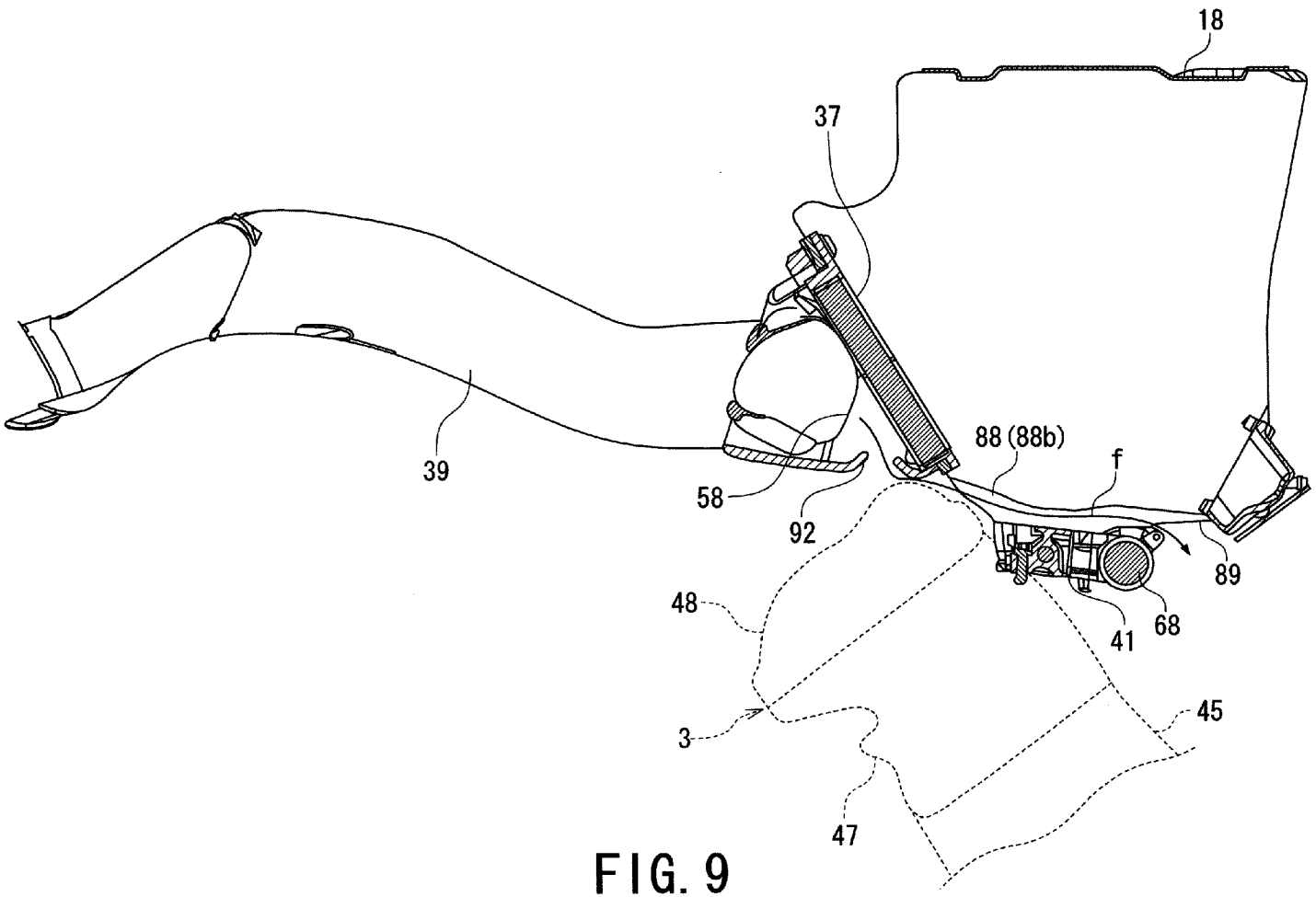
FIG. 9 is an illustrated vertical sectional view of the intake structure of the motorcycle according to the embodiment of the present invention.
Figure 10:
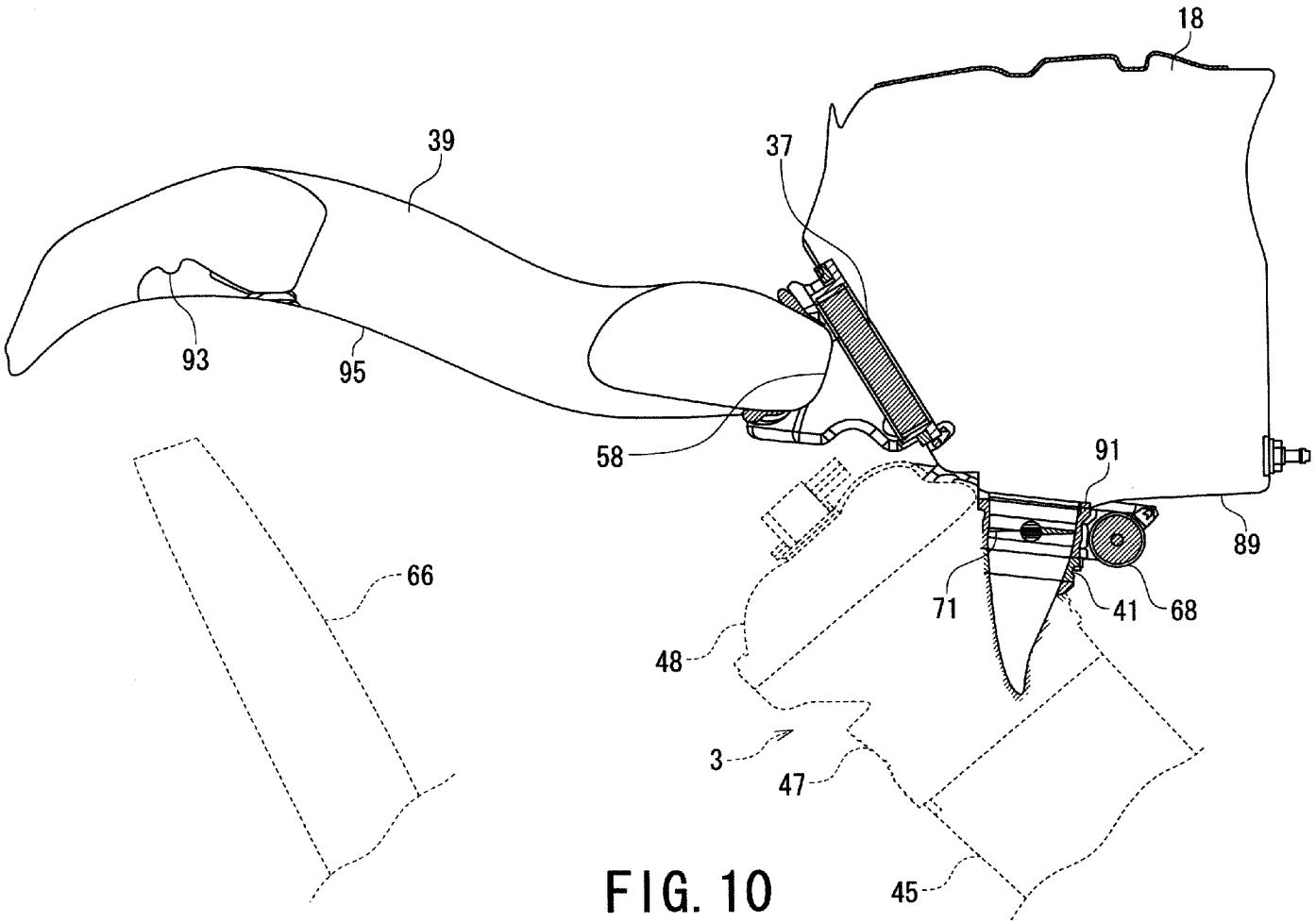
FIG. 10 is also an illustrated vertical sectional view of the intake structure of the motorcycle according to the embodiment of the present invention.
Figure 11:
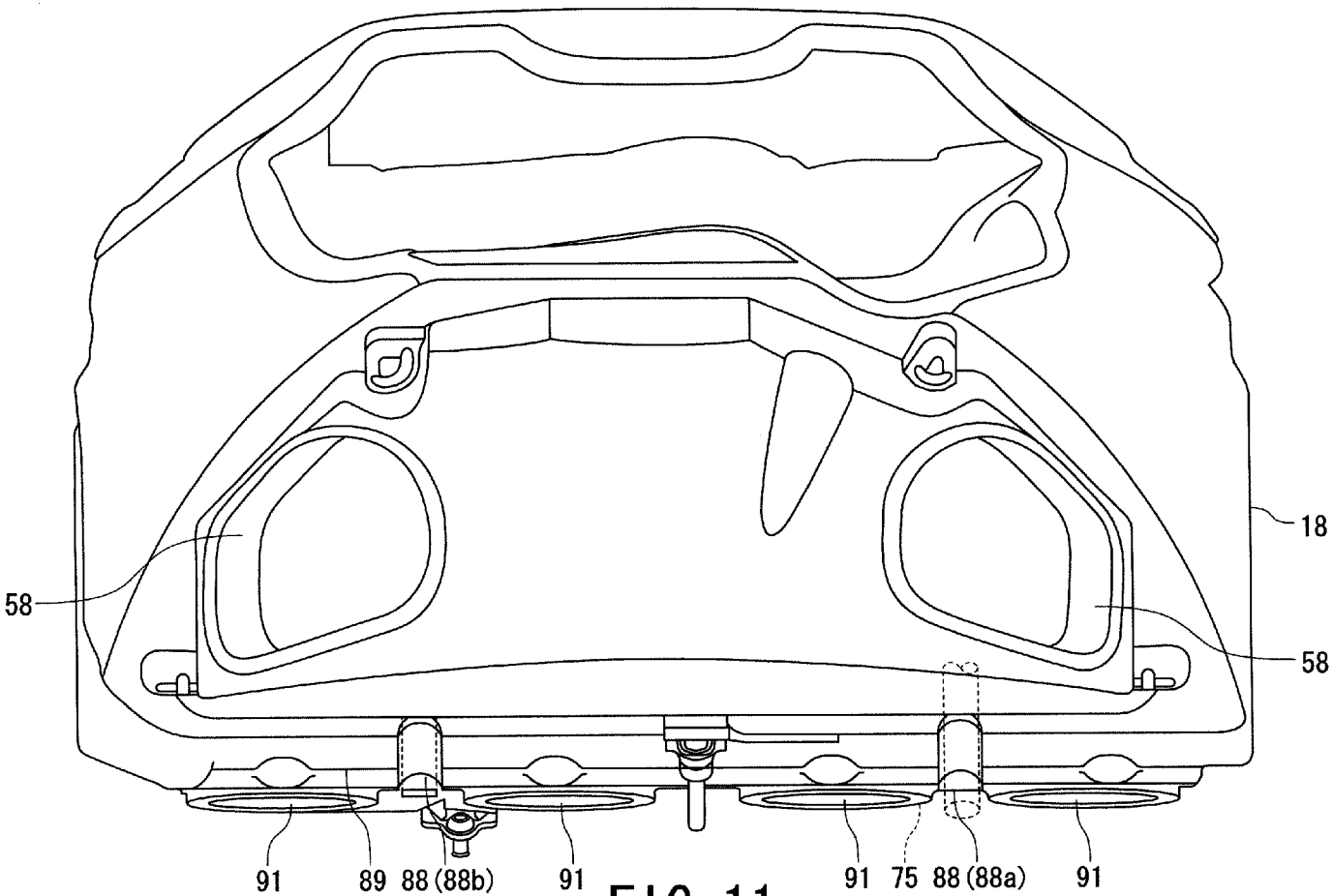
FIG. 11 is a front view illustrating the air cleaner box of the intake structure of the motorcycle according to the embodiment of the present invention.

Hereunder, the air ducts 39, the air cleaner box 18 and the electronically controlled throttle will be described with reference to FIGS. 7 to 12, in which FIG. 7 is the bottom view illustrating the intake structure of the motorcycle, FIG. 8 is the bottom view illustrating the air ducts and the air cleaner box of the intake structure of the motorcycle, FIG. 9 is a vertical sectional view illustrating the intake structure of the motorcycle along a line IX-IX in FIG. 7, FIG. 10 is a vertical sectional view illustrating the intake structure of the motorcycle taken along a line X-X in FIG. 7, and FIG. 11 is a front view illustrating the air cleaner box of the intake structure of the motorcycle.

As shown in FIGS. 7 to 11, the intake structure of the motorcycle 1 according to the present embodiment includes a bottom wall 89 of the air cleaner box 18. The bottom wall 89 is formed with a wind guide groove 88 for guiding the running wind flowing into the gap between the cylinder head 47 and the air cleaner box 18 to the vicinity of the electric motor 68 from the front side of the throttle body 41.

The bottom wall 89 of the air cleaner box 18 faces the throttle body 41 or the engine 3, and is formed with four openings 91 communicating with the throttle bores 77 in addition to the wind guide groove 88. The four openings 91 are arranged in the vehicle width direction in a manner similar to the throttle bores 77.

The wind guide groove 88 extends in the longitudinal direction between the throttle bores 77 adjacent to each other in plan view. Specifically, two wind guide grooves 88 are formed, in which one of the wind guide grooves 88*a* extends in the longitudinal direction between the left-side two openings 91 and the other one of the wind guide grooves 88*b* extends in the longitudinal direction between the right-side two openings 91. Thus, the wind guide groove 88*a* extends in the longitudinal direction at the intermediate position between the two throttle bores 77 on the left side of the vehicle, and the wind guide groove 88*b* extends in the longitudinal direction at the intermediate position between the two throttle bores 77 on the right side of the vehicle in plan view of the vehicle.

The wind guide groove 88*a* is a cutout groove in which the cable 75 transmitting the throttle operation from the throttle grip 26 to the measuring device 81 is arranged.

The bottom wall 89 has a first wind guide hole 92 formed on the front side of the throttle body 41 and on the rear side of the front end of the cylinder head 47 so as to guides the air to the wind guide groove 88 from the interior of the air cleaner box 18.

The first wind guide hole 92 is positioned on the upstream side (so-called dirty side) of the air cleaner 37 in the air flowing in the air duct 39 and air cleaner box 18 so as to guide air not passing through the air cleaner 37 the wind guide groove 88. The first wind guide hole 92 includes a pair of right and left openings which lie on extension lines of the wind guide grooves 88, respectively.

The intake structure of the motorcycle 1 is also formed with a bottom wall 95 of each of the air ducts 39. The bottom wall 95 has a second wind guide hole 93 located on the front side of the throttle body 41 so as to guide the air from the interior of the air duct 39 to the wind guide groove 88.

In order to efficiently introduce the running wind into the air cleaner box 18, the air ducts 39 are opened at a front end of the vehicle, and branched to right and left sides with a distance therebetween being gradually widened so as to bypass the steering head pipe 13 and the steering mechanism 5. After passing through peripheries of the steering head pipe 13 and the steering mechanism 5, the air ducts 39 approach each other and are connected to the air duct connection ports 58 of the air cleaner box 18.

Each of the second wind guide hole 93 is located on the rear side of the radiator 66 which is located in front of the cylinder 45. The second wind guide hole 93 is formed with a pair of right and left openings which are located outside the extension line of the wind guide grooves 88 in the vehicle width direction, respectively.

The intake structure of the motorcycle 1 having the configuration as described above introduces the running wind from the air ducts 39 into the air cleaner box 18 and sends the intake air to the engine 3 through the throttle body 41.

The intake structure of the motorcycle 1 includes the electronically controlled throttle performing the opening/closing operation of the throttle valve 71 by the electric motor 68 to thereby adjust the flow rate of intake air. The electric motor 68 performs the opening/closing operation of the throttle valve 71 by utilizing the rotation angle of the throttle pulley 72 measured by the accelerator position sensor 73 as the operation amount of the throttle grip 26. Thus, if the throttle pulley 72 is rotated due to vibrations caused by the running of the motorcycle 1 or vibrations generated by the engine 3, the accelerator position sensor 73 will erroneously measure the operation amount of the throttle grip 26, thus being defective.

To overcome such defect, according to the intake structure of the motorcycle 1 of the present embodiment, the flexible intake pipe 64 made of rubber is interposed between the throttle body 41 and the engine 3 so as to protect the throttle body 41 from the suffering of the vibrations caused by the running motorcycle 1 or the engine 3 being operated, and eventually suppresses the vibrations of the measuring device 81 supported by the throttle body 41 (FIG. 3).

According to the intake structure of the present embodiment, since the vibrations of the measuring device 81 can be suppressed, the throttle pulley 72 is prevented from being rotated due to the vibrations. Accordingly, the accelerator position sensor 73 can perform measurement with higher reliability.

In the intake structure of the motorcycle 1 according to the present embodiment, the throttle pulley 72 is arranged on the rear side of the throttle body 41 or the electric motor 68. Thus, the throttle pulley 72 is not exposed to outside, and hence, the outer appearance of the motorcycle is not spoiled.

In addition, the intake structure of the motorcycle 1 according to the present embodiment can also avoid an increase in the vehicle width.

Furthermore, in the intake structure of the motorcycle 1 according to the present embodiment, since the throttle pulley 72 is arranged on the rear side of the gap between the left-side two throttle bores 77, and the cable 75, is arranged in the wind guide groove 88*a*, the cable 75 can be connected to the throttle grip 26 without bending the cable 75 in a complicated shape or in a shape with a small curvature radius. Accordingly, with the intake structure of the motorcycle 1 of the present embodiment, the throttle grip 26 can offer a rider a natural and better operational feeling.

As described hereinbefore, according to the intake structure of the motorcycle 1 of the present embodiment, the operation amount of the throttle grip 26 can be measured with high reliability even in a vibration environment and the outer appearance of the vehicle can be prevented from being spoiled, thus being advantageous.

Incidentally, in another aspect of the intake structure of the motorcycle 1 of the present embodiment, the following characteristic structure and function may be provided.

That is, with reference to FIGS. 1 to 6, and particularly, FIGS. 4 to 6, the intake structure of the motorcycle 1 includes the electronically controlled throttle that drives the opening and closing of the throttle valve 71 by the electric motor 68 to thereby adjust the flow rate of intake air, as described hereinbefore.

In the intake structure of the motorcycle 1, the electric motor 68 is preferably arranged as close as possible to the throttle body 41 so as to reduce a capacity required to arrange the electronically controlled throttle. However, when the electric motor 68 is arranged close to the throttle body 41, the electric motor 68 is also arranged close to the engine 3. Thus, the electric motor 68 is apt to be affected by heat generated by the engine 3 or heat generated by the electric motor 68 itself, thus being defective.

To avoid such defect, according to the intake structure of the motorcycle 1 of the present embodiment, the fuel supply pipe 85 (more specifically, the cylinder head-side connection end 86) is arranged between the cylinder 45 and the electric motor 68 so as to block the heat generated by the engine 3. The electric motor 68 can hence be arranged close to the throttle body 41. Further, during the running of the motorcycle 1, since a new fuel always passes through the fuel supply pipe 85, the fuel supply pipe 85 can effectively block the heat generated by the engine 3.

In the intake structure of the motorcycle 1 according to the present embodiment, the electric motor 68 is arranged in the projection area or space on the rear side of the cylinder head 47, so that it is not necessary to ensure a capacity to arrange the electric motor 68 between the head cover 48 and the air cleaner box 18. Thus, there is no need to reduce a volume of the air cleaner box 18.

In the intake structure of the motorcycle 1 of the present embodiment, the fuel supply pipe 85 (more specifically, the cylinder head-side connection end 86) is arranged in the valley-shaped space formed by the cylinder 45 and the electrical component 55. Thus, the valley-shaped space is effectively usable. Accordingly, the electronically controlled throttle and a fuel supply system can be compactly arranged.

In the intake structure of the motorcycle 1 according to the present embodiment, since the electric motor 68 is arranged below the top portion of the throttle body 41, the air cleaner box 18 and the fuel tank 19 can be prevented from being reduced in capacity.

In the meantime, if the cable 75 passes through the vicinity of the cylinder 45, the cable 75 expands and contracts due to the heat generated by the engine 3, and in such a case, the cable 75 may not accurately transmit the operation amount of the throttle grip 26 due to an error factor such as a bias between a hot state and a cold state, which may result in a cause of an error in measurement by the measuring device 81. In order to avoid such defect, according to the intake structure of the motorcycle 1 of the present embodiment, the throttle pulley 72 is arranged on the rear side of the electric motor 68, thereby arranging the cable 75 along a path away from the cylinder 45. The throttle pulley 72 is also arranged at a position further apart from the engine 3 than the electric motor 68. Accordingly, the measuring device 81 is prevented from making an error in measurement.

Furthermore, in the intake structure of the motorcycle 1 according to the present embodiment, the fuel supply pipe 85, the electric motor 68, and the throttle pulley 72 are located in the valley-shaped space formed by the cylinder 45 and the electrical component 55 in a manner such that the cylinder head-side connection end 86 of the fuel supply pipe 85, the output axis of the electric motor 68, and the rotation center line of the throttle pulley 72 are arranged in an inverted triangle shape, and at least one side of the inverted triangle shape is arranged along the wall surface of the engine 3 or a wall surface of the electrical component 55 that defines the valley-shaped space. The valley-shaped space portion is thereby effectively used. Accordingly, the intake structure is effectively arranged without forming a dead space between the engine 3 and the air cleaner box 18 to thereby provide the intake structure having a compact size.

As described above, with the intake structure of the motorcycle 1 of the present embodiment of the above aspect, a capacity of a region to arrange the throttle body 41 and the electric motor 68 can be reduced by closely arranging the throttle body 41 and the electric motor 68.

It is further to be noted that the present invention is not limited to the described embodiments and many other changes and modifications or alternations may be made without departing from the scopes of the appended claims.

What is claimed is:

1. An intake structure of a motorcycle having a head pipe, a vehicle body frame including a pair of left and right main frames extending rearward from the head pipe, and an engine disposed below the vehicle body frame and including a cylinder having an inclined cylinder axis, the intake structure comprising:

an air cleaner box disposed above the engine and the main frames;

a throttle body provided with a plurality of throttle bores formed and arranged in a vehicle width direction of the vehicle body frame and a valve shaft penetrating the throttle bores so as to extend in the vehicle width direction of the vehicle body frame, the throttle body being located on a rear side of the engine and between the pair of left and right main frames and configured to guide intake air from the air cleaner box to the engine; and a measuring device located on a rear side of the throttle body and configured to rotate about a rotational shaft parallel to the valve shaft to thereby measure a throttle operation amount.

2. The intake structure of the motorcycle according to claim 1, wherein the measuring device includes a throttle pulley located on a rear side of a gap between adjacent throttle bores and configured to rotate about the rotational shaft to measure the throttle operation amount, and a cable that transmits a throttle operation from a throttle grip to the throttle pulley through the gap in a plan view.

3. The intake structure of the motorcycle according to claim 2, wherein the air cleaner box is formed, in a bottom surface thereof so as to face the throttle body or engine, with a cutout groove in which is arranged.

4. An intake structure of a motorcycle having a head pipe, a vehicle body frame extending rearward from the head pipe, a fuel tank, and an engine disposed below the vehicle body frame and including a cylinder having an inclined cylinder axis and a cylinder head closing a top portion of the cylinder, the intake structure comprising:

an air cleaner box disposed above the engine and the main frames and on a rear side of the fuel tank;

a throttle body including a throttle valve located between the air cleaner box and the cylinder head and configured to adjust a flow rate of an intake air, the throttle body being located below the air cleaner box on a rear side of the cylinder head;

an electric motor located in a projected area on the rear side of the cylinder head and configured to open and close the throttle valve; and a fuel supply pipe disposed between the cylinder and the electric motor and connecting the fuel tank and the cylinder head.

5. The intake structure of the motorcycle according to claim 4, wherein the electric motor is supported at a rear portion of the throttle body, the fuel supply pipe disposed below the electric motor and connected to the cylinder head, and includes a connection end to be connected to the cylinder head, and extending directions of an output shaft of the electric motor and the connection end of the fuel supply pipe lie within a plane substantially parallel to a center line of a throttle bore that accommodates the throttle valve.

6. The intake structure of the motorcycle according to claim 4, further comprising an electrical component disposed on a rear side of the cylinder so as to define a valley-shaped space together with the cylinder, in which the fuel supply pipe is arranged.

7. The intake structure of the motorcycle according to claim 6, wherein the electric motor is located below a top portion of the throttle body.

8. The intake structure of the motorcycle according to claim 6, further comprising a throttle pulley disposed on a rear side of the electric motor and configured to measure a throttle operation amount.

9. The intake structure of the motorcycle according to claim 8, wherein the fuel supply pipe, the electric motor, and the throttle pulley are disposed within in the valley-shaped space such that the connection end of the fuel supply pipe, the output axis of the electric motor, and a rotation center line of the throttle pulley are arranged so as to provide an inverted triangle shape in side view of a vehicle, and at least one side of the inverted triangle shape is arranged along a wall surface of the engine or a wall surface of the electrical component that defines the valley-shaped space.

* * * * *